US009356402B2

(12) United States Patent
Sung et al.

(10) Patent No.: US 9,356,402 B2
(45) Date of Patent: May 31, 2016

(54) MULTIMEDIA LINK HAVING A PLUG AND A RECEPTACLE WITH A POWER LINE CONFIGURED AS A SIGNAL RETURN PATH

(71) Applicant: Silicon Image, Inc., Sunnyvale, CA (US)

(72) Inventors: Baegin Sung, Sunnyvale, CA (US); Chandlee B. Harrell, Los Altos, CA (US); Gyudong Kim, Sunnyvale, CA (US); Shrikant Ranade, Campbell, CA (US)

(73) Assignee: Lattice Semiconductor Corporation, Portland, OR (US)

( * ) Notice: Subject to any disclaimer, the term of this patent is extended or adjusted under 35 U.S.C. 154(b) by 0 days.

(21) Appl. No.: 14/636,052

(22) Filed: Mar. 2, 2015

(65) Prior Publication Data

US 2015/0255933 A1 Sep. 10, 2015

Related U.S. Application Data

(60) Provisional application No. 61/947,704, filed on Mar. 4, 2014.

(51) Int. Cl.
*H01R 13/648* (2006.01)
*H01R 13/6585* (2011.01)
*H01R 13/6471* (2011.01)

(52) U.S. Cl.
CPC ..... *H01R 13/6585* (2013.01); *H01R 13/6471* (2013.01)

(58) Field of Classification Search
CPC ..... H01R 24/22; H01R 24/30; H01R 13/648; H01R 13/6485; H01R 13/658; H01R 13/6581; H01R 13/6585
USPC ..... 439/607.01, 607.05
See application file for complete search history.

(56) References Cited

U.S. PATENT DOCUMENTS 6,024,587 A * 2/2000 Garth ..... H05K 1/0218 439/101
7,670,156 B2 * 3/2010 Chen ..... H01R 13/6485 439/108
7,865,629 B1 * 1/2011 Tantos ..... G06F 13/385 710/11
8,251,740 B2 * 8/2012 Grice ..... H01R 13/641 439/490
8,340,529 B2 * 12/2012 Shastri ..... G09G 5/006 398/141
9,240,652 B2 * 1/2016 Dai ..... H01R 13/635
2010/0316388 A1 12/2010 Shastri et al.

(Continued)

OTHER PUBLICATIONS

PCT International Search Report and Written Opinion, PCT Application No. PCT/US2015/018452, Jun. 10, 2015, 10 pages.

*Primary Examiner* — Chandrika Prasad
(74) *Attorney, Agent, or Firm* — Fenwick & West LLP

(57) ABSTRACT

In one embodiment, a source device and sink device communicate with one another via a multimedia link. The multimedia link includes a cable and a plug. The cable includes one or more data lines, power lines, ground lines or control bus lines. The plug includes a plurality of pins each connected to the one or more lines included in the cable. The plug also includes a ground plane and a power plane, wherein a ground pin of the plug connects the ground plane to the ground line of the cable of the multimedia link and a power pin of the plug connects the ground plane to the power line of the cable. In one example, the ground plane and power plane are placed within a threshold distance of one another, such that the power line connected to the power plane via the power pin behaves as a signal return path.

14 Claims, 5 Drawing Sheets

(56) References Cited

U.S. PATENT DOCUMENTS

| | | | | |
|---|---|---|---|---|
| 2011/0125601 | A1* | 5/2011 | Carpenter | G06Q 30/06 705/26.1 |
| 2011/0125930 | A1 | 5/2011 | Tantos et al. | |
| 2012/0064758 | A1 | 3/2012 | Grice et al. | |
| 2012/0077384 | A1 | 3/2012 | Bar-Niv et al. | |
| 2013/0340024 | A1 | 12/2013 | MacDougall | |
| 2014/0179138 | A1* | 6/2014 | Dai | H01R 13/635 439/159 |
| 2014/0248801 | A1* | 9/2014 | Riezebos | H04B 5/0031 439/607.01 |
| 2015/0171562 | A1* | 6/2015 | Gao | H01R 13/6582 439/345 |

* cited by examiner

MULTIMEDIA LINK HAVING A PLUG AND A RECEPTACLE WITH A POWER LINE CONFIGURED AS A SIGNAL RETURN PATH

CROSS REFERENCE TO RELATED APPLICATION

This application claims priority from U.S. Provisional Patent Application No. 61/947,704, titled "Reversible Connector" filed on Mar. 4, 2014, the contents of which are incorporated by reference herein in their entirety.

BACKGROUND

1. Field of the Disclosure

This disclosure pertains in general to data communications, and more specifically to high speed wired communications via multimedia links and connectors.

2. Description of the Related Art

High Speed wired communication via multimedia links has serious challenges with respect to the loss of signal integrity during the transmission of communications via one or more connectors and/or cables associated with the multimedia links. Attenuation, crosstalk, and the size of the cable/connectors are all concerns for designers and manufacturers of multimedia links. Further, addressing one concern often has a trade off with respect to another. For example, crosstalk can be reduced with by ensuring a larger spacing among the signal wires, which however increase the physical dimension and cost.

Further, to increase the data throughput of the cable/connector of a multimedia link, the data rate of a signal pair within the multimedia link needs to be increased and/or the number of signal pairs within the multimedia link needs to be increased. Increasing the number of the signal pairs within a multimedia link has a number of difficulties. For example, to incorporate more signal pairs within the multimedia link the width of the connector of the multimedia link must be increased. Apart from increasing the cost of the multimedia link, increasing the width of the connector of the multimedia link results in the signal integrity of the pairs close to the ends of the connector being different from that of the pairs close to the center of the connector which can be quite a problem.

Increasing the data rate of a signal pair within the multimedia link so as to increase the data throughput of the multimedia link poses its own problems, as the cable attenuation increases significantly when the signal frequency increases. Further, there is practical difficulty in increasing the data rate of a signal pair within a multimedia link as there is a trade-off between the increased data rate and the increased complexity/power consumption of the communication system. Thus, it is beneficial to make connectors of a multimedia link more compact while enhancing the signal integrity of the multimedia link, thereby making the multimedia link economical and suitable for high speed wired communication.

SUMMARY

Embodiments of the present disclosure are related to enhancing or improving the integrity of signals transmitted via a multimedia link. In one embodiment, a source device and sink device communicate with one another via a multimedia link. The multimedia link includes a cable and a plug. The cable includes one or more data lines, power lines, ground lines or control bus lines. The plug includes a plurality of pins each connected to the one or more lines included in the cable.

In one embodiment, the plug also includes a ground plane and a power plane, wherein a ground pin of the plug connects the ground plane to a ground line included in the cable of the multimedia link and a power pin of the plug connects the ground plane to a power line included in the cable of the multimedia link. In one example, the ground plane and power plane are placed within a threshold distance of one another, such that the power line connected to the power plane via the power pin behaves as a signal return path. As both the ground line of the multimedia link and the power line of the multimedia link act as signal return paths the signal integrity of the multimedia link is enhanced.

In one embodiment, the multimedia link is connected to a receptacle of either the source device or the sink device. The receptacle interfaces with the plug of the multimedia link to receive and transmit signals to and from the multimedia link and the device associated with the receptacle. The receptacle includes a plurality of pins, such as a ground pin, a power pin, and one or more differential pair pins. In one embodiment, the receptacle also includes a ground plane and a power plane. In one example, the ground plane and power plane are placed within a threshold distance of one another, such that a power line connected to the power plane via the power pin behaves as a signal return path. In one example, the receptacle is connected to a receptacle cable that connects the receptacle to additional circuitry of the device associated with receptacle. The receptacle cable includes a plurality of lines, such as a power line or ground line that are connected to the various pins of the receptacle.

As both the ground line associated with the receptacle and the power line of the multimedia link act as signal return paths the signal integrity of the receptacle is enhanced. In one embodiment, the receptacle includes an upper plane and a lower plane, wherein each plane includes a plurality of pins. In one example, the receptacle includes a shield plane between the upper plane and the lower plane. The shield plane reduces the crosstalk between the signals transmitted via the upper plane and the lower plane of the receptacle. Further, the shield plane helps control the impedance of one or more components of the receptacle. For example, the distance of the shield plane from one or more pins of the upper plane or the lower plane helps control the characteristic impedance of the pins. In some embodiments, the plug of the multimedia link includes a shield plane located behind each pin of the plug. The distance between the shield plane located behind each pin of the plug and the pin of the plug helps determine the characteristic impedance of each pin of the plug.

BRIEF DESCRIPTION OF THE DRAWINGS

The teachings of the embodiments disclosed herein can be readily understood by considering the following detailed description in conjunction with the accompanying drawings.

DETAILED DESCRIPTION

The Figures (FIG.) and the following description relate to various embodiments by way of illustration only. It should be noted that from the following discussion, alternative embodiments of the structures and methods disclosed herein will be readily recognized as viable alternatives that may be employed without departing from the principles discussed herein. Reference will now be made in detail to several embodiments, examples of which are illustrated in the accompanying figures. It is noted that wherever practicable similar or like reference numbers may be used in the figures and may indicate similar or like functionality.

Figure 1:
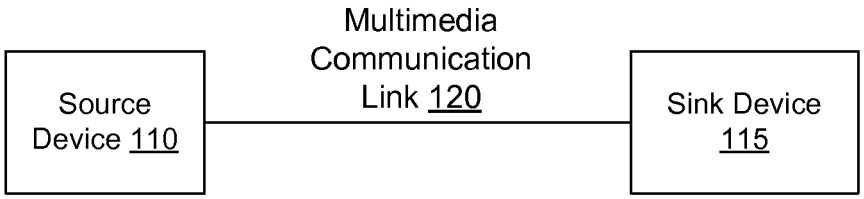
FIG. 1 is a high-level block diagram of a system for data communications, according to one embodiment.

FIG. 1 is a high-level block diagram of a system 100 for data communications, according to one embodiment. The system 100 includes a source device 110 communicating with a sink device 115 through a multimedia link 120. The source device 110 transmits multimedia data streams (e.g., audio/video streams) to the sink device 115 and also exchanges control data with the sink device 115 through the multimedia link 120. In one embodiment, source device 110 and/or sink device 115 may be repeater devices.

The source device 110 may include a physical communication port configured to couple to the multimedia link 120. The sink device 115 may also include a physical communication port configured to couple to the multimedia link 120. Signals exchanged between the source device 110 and the sink device 115 across the multimedia link 120 pass through the physical communication ports.

The source device 110 and sink device 115 exchange data using various protocols. In one embodiment, multimedia link 120 represents a Mobile High-Definition Link (MHL) cable. The MHL cable 120 supports differential signals transmitted via a plurality of data lines. Each differential pair of lines forms a logical communication channel that carries multimedia data streams. The MHL cable 120 may further include a pair of Consumer Electronics Control (CEC) control bus lines; a power line, and a ground line. In some embodiments, the sink device 115 may utilize a control bus line for the transmission of closed loop feedback control data to source device 110.

In one embodiment, the multimedia link 120 represents a High Definition Multimedia Interface (HDMI) cable. The HDMI cable 120 supports differential signals transmitted via data lines. Each differential pair of lines forms a logical communication channel that carry multimedia data streams. The HDMI cable 120 may further include differential clock lines; Consumer Electronics Control (CEC) control bus; Display Data Channel (DDC) bus; power line, ground line; hot plug detect line; and four shield lines for the differential signals. In some embodiments, the sink device 115 may utilize the CEC control bus for the transmission of closed loop feedback control data to source device 110.

In one embodiment, a representation of the source device 110, the sink device 115, or components within the source device 110 or sink device 115 may be stored as data in a non-transitory computer-readable medium (e.g. hard disk drive, flash drive, optical drive). These descriptions may be behavioral level, register transfer level, logic component level, transistor level and layout geometry-level descriptions.

Embodiments of the present disclosure are related to enhance the integrity of signals transmitted via the multimedia link between the source device 110 and the sink device 115. Further, embodiments of the present disclosure are related to controlling the impedance of various components of the multimedia link 120, the source device 110, or the sink device 115.

Figure 2:
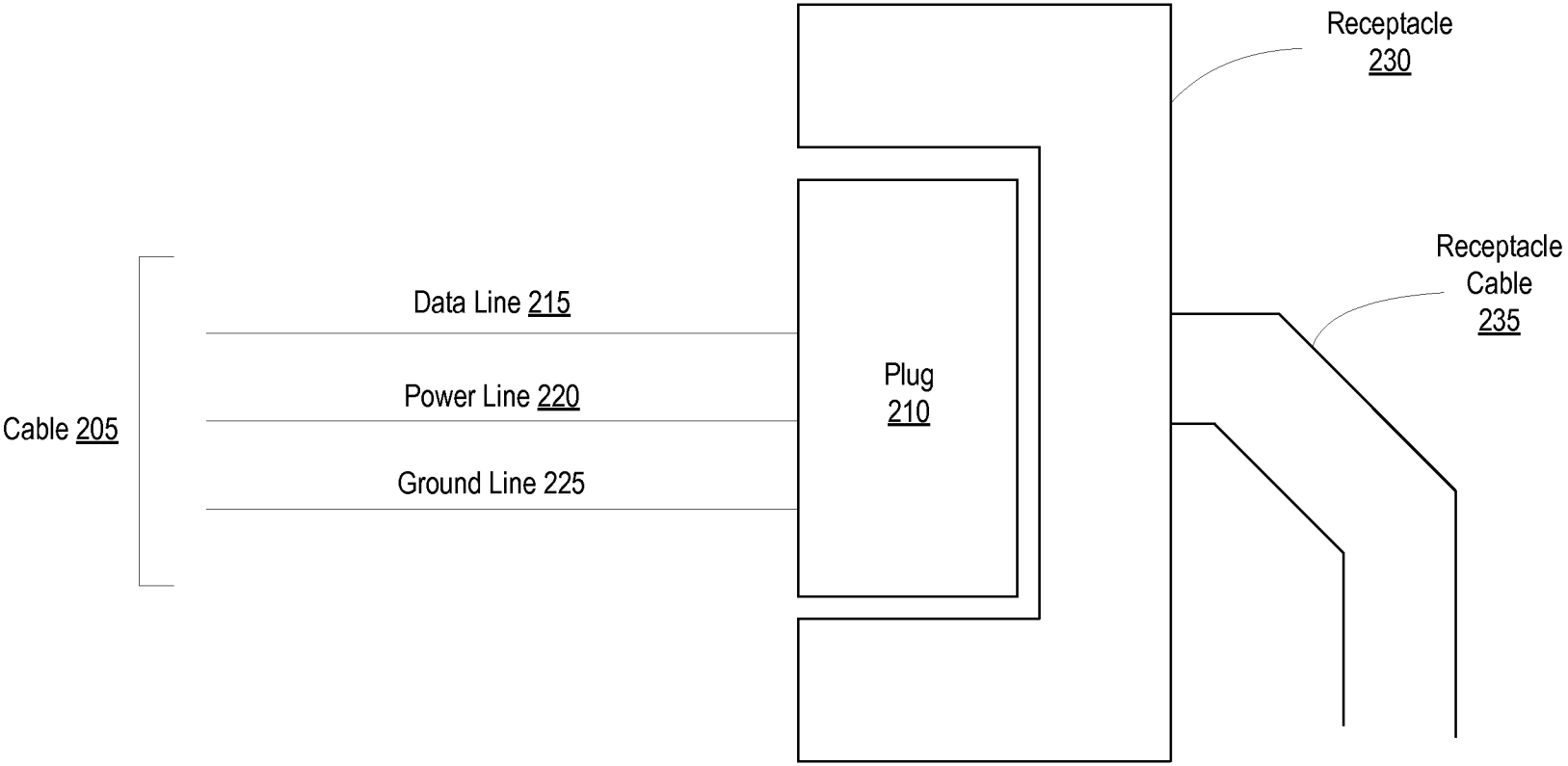
FIG. 2 is a diagram illustrating the multimedia link interfacing with the source device or the sink device, according to one embodiment.

FIG. 2 is a diagram illustrating the multimedia link interfacing with the source device or the sink device, according to one embodiment. In the example of FIG. 2 the multimedia link 120 includes a cable 205 and a plug 210. In other embodiments, the multimedia line 120 may include additional components not shown in the example of FIG. 2. The cable 205 includes one or more data lines 215, power lines 220, and ground lines 225. The data line 215 represents a differential pair of wires that carry multimedia data streams between the source device 110 and the sink device 115. The power line 220 represents a wire for carry power from the source device 110 to the sink device 115. The ground line 225 includes a wire that behaves as a signal return path for signals transmitted via the multimedia link 120. The cable 205 may also include a control bus line for transmitting control signals between the source device 110 and the sink device 115.

The plug 210 of the multimedia link 120 connects the multimedia link 120 to a receptacle 230 of the source device 110 or the sink device 115. In one embodiment, the plug 210 includes a plurality of pins. Each pin of the plug 210 is connected to either a data, power, ground or control line included in the cable 205 of the multimedia link 120. The pins included in the plug 205 of the multimedia link 120 may be placed in a variety of positions within the plug 210. Further, in various embodiments, the plug 210 may include various numbers of pins. In one example, the plug 210 of the multimedia link 120 is configured to interface with a particular type of receptacle 230. The plug 210 may also include a ground plane and a power plane, as is further described in conjunction with FIG. 3A below.

In one embodiment, the port of the source device 110 or the sink device 115 includes one or more receptacles 230. The receptacle 230 is configured to receive and connect to the plug 210 of the multimedia link 120, thereby allowing the transmission of signals from the source device 110 to the sink device 115 (or vice-versa) through the multimedia link 120 and the receptacle 230. Like the plug 210, the receptacle 230 may include a plurality of pins that may be positioned in a variety of configurations within the receptacle 230. Further, in various embodiments, the receptacle 230 may include various numbers of pins. In one example, the receptacle 230 of the multimedia link 120 is configured to interface with a particular type of plug 210. The receptacle 230 may also include a ground plane and a power plane, as is further described in conjunction with FIG. 4 below.

The receptacle 230 is connected to a receptacle cable 235 that includes one or more lines. The receptacle cable 235 connects the receptacle 230 to additional circuitry included in the source device 115 or the sink device 110 for handling and processing signals received by the receptacle 230 via the multimedia link 120. The receptacle cable 235 may include one or more data lines or power lines for transmitting signals received from the multimedia link 120 to the additional circuitry connected to the receptacle 230. The pins of the receptacle 230 are connected to the respective lines of the receptacle cable 235. The plug 210 and the receptacle 230 are configured to interface such that the pins of the plug 210 connect with the respective pins of the receptacle 230.

Figure 3A:
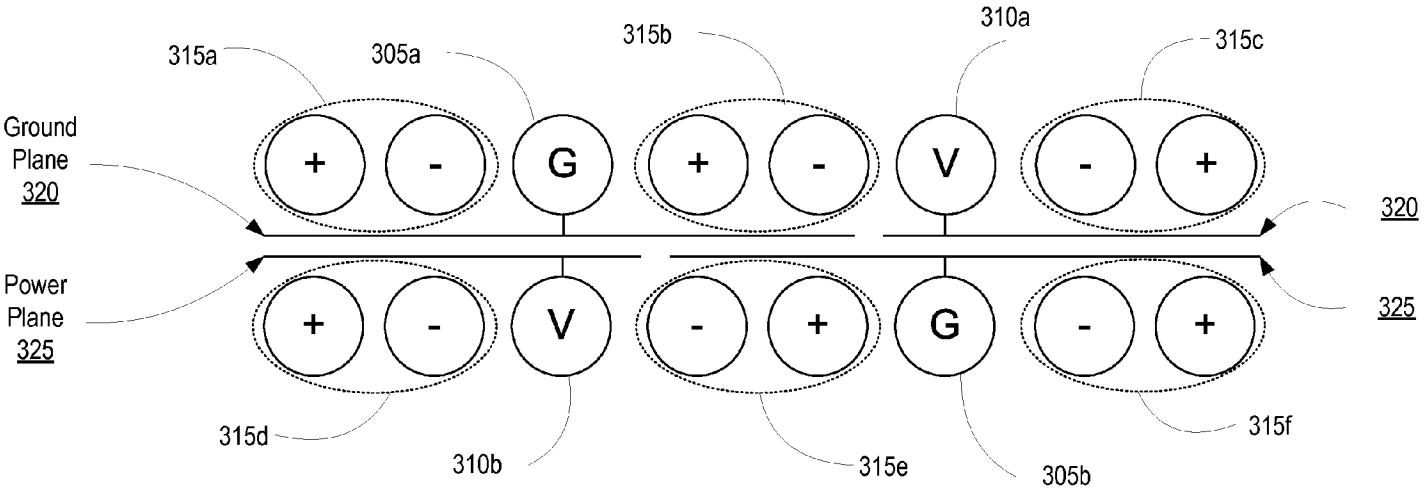
FIG. 3A is a diagram illustrating the organization of pins in the plug of the multimedia link, according to one embodiment.

FIG. 3A is a diagram illustrating the organization of pins in the plug of the multimedia link, according to one embodiment. In other embodiments the pins of plug 210 may be organized differently, and the plug 210 may include additional components not shown in FIG. 3A. As described above, during high speed wired communication the cable attenuation experienced by the multimedia link 120 increases when the frequency of the signal and data being transmitted via the multimedia link 120 increases, often leading to the loss of signal integrity. Signal integrity is a measure of the quality of the signal being transmitted via the multimedia link 120. The transmission of data across the multimedia link 120 at high communication speeds often results in the degradation of the integrity of the signal being transmitted across the multimedia link 120. The organization of the pins of the plug 210 as described in FIG. 3A is one example of enhancing the signal integrity of high speed communications transmitted via the multimedia link 120 without significantly increasing the cost of the multimedia link 120.

In the example of FIG. 3A, the plug 210 of the multimedia link includes one or more ground pins 305, one or more power pins 310, one or more differential pair pins 315, a ground plane 320, and a power plane 325. The pins in the plug 210 are each connected to their respective lines or wires included in the cable 205 of the multimedia link 120. For example, a ground pin is connected to the ground line included in the cable 205 of the multimedia link 120.

In one embodiment, the ground plane 320 and the power plane 325 are placed substantially very close to one another in the plug 210 of the multimedia link 120. Placing the ground plane 320 and the power plane 325 very close to one another, results in the power plane 325 being AC (alternate current) coupled to the ground plane 320, thereby allowing the power pins 310, more specifically the power lines of the multimedia link 120 connected to the power pins 310, connected to the power plane 325 to behave as a signal return path in addition to the ground lines of the multimedia link 120. By having the power lines of the multimedia link 120 behave as signal return paths in addition to the ground lines of the multimedia link 120 the signal integrity of signals transmitted via the multimedia link 120 is enhanced. Thus, by placing the ground plane 320 and the power plane 325 of the plug 210 very close to one another (within a threshold distance such that the power plane 325 is AC coupled to the ground plane 320) the signal integrity of signals transmitted via the multimedia link 120 is enhanced.

In one embodiment, the ground pins 305, the power pins 310, and the differential pair pins 315 are organized in the plug 210 of the multimedia link 120, such that a ground pin 305 and a power pin 310 is placed between each pair of differential pair pins 315. As shown in the example of FIG. 3A, ground pin 305*a* is placed between differential pair pins 315*a* and 315*b*, ground pin 305*b* is placed between differential pair pins 315*e* and 315*f*, power pin 310*a* is placed between differential pair pins 315*b* and 315*c*, and power pin 310*b* is placed between differential pair pins 315*d* and 315*e*.

Figure 3B:
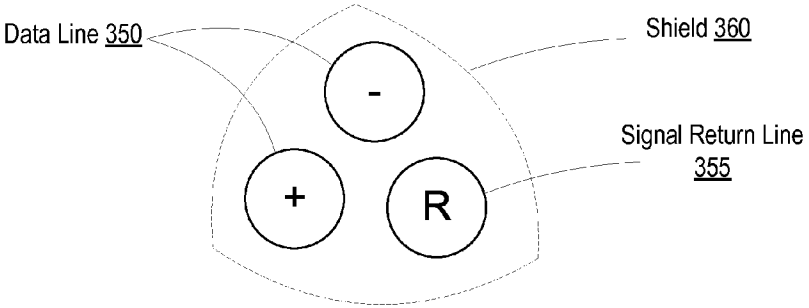
FIG. 3B is a diagram illustrating the construction of the various lines included within the cable of the multimedia link, according to one embodiment.

FIG. 3B is a diagram illustrating the construction of the various lines included within the cable of the multimedia link, according to one embodiment. In the example of FIG. 3B the construction of a single differential pair or data line within the cable 205 of the multimedia link 120 is shown. In other embodiments, the cable 205 of the multimedia link 120 may include multiple such constructions for the various differential pair lines included in the cable 205, or different types of constructions from those shown in FIG. 3B.

In the example of FIG. 3B the construction within the cable includes a data line 350 including a differential pair of wires, a signal return line 355, and a shield 360 encompassing the data line 350 and signal return line 355. As described above, the data line 350 transmits data between the source device 110 and the sink device 115. The signal return line 355 is the signal return path followed by signals transmitted via the multimedia link 120. As described above, in conjunction with FIG. 3A, the signal return line 355 may be either a power line or a ground line, as the ground plane 320 and power plane 325 of the plug 210 are placed quite closed to one another, thereby allowing the power lines of the multimedia link 120 to behave as signal return paths. The shield 360 encompassing the differential pair lines 350 and the signal return line 355 insulates the signals transmitted via the differential pair lines 350 and the signal return line 355 to reduce electric noise present outside the shield from affecting the transmitted signals.

Figure 4:
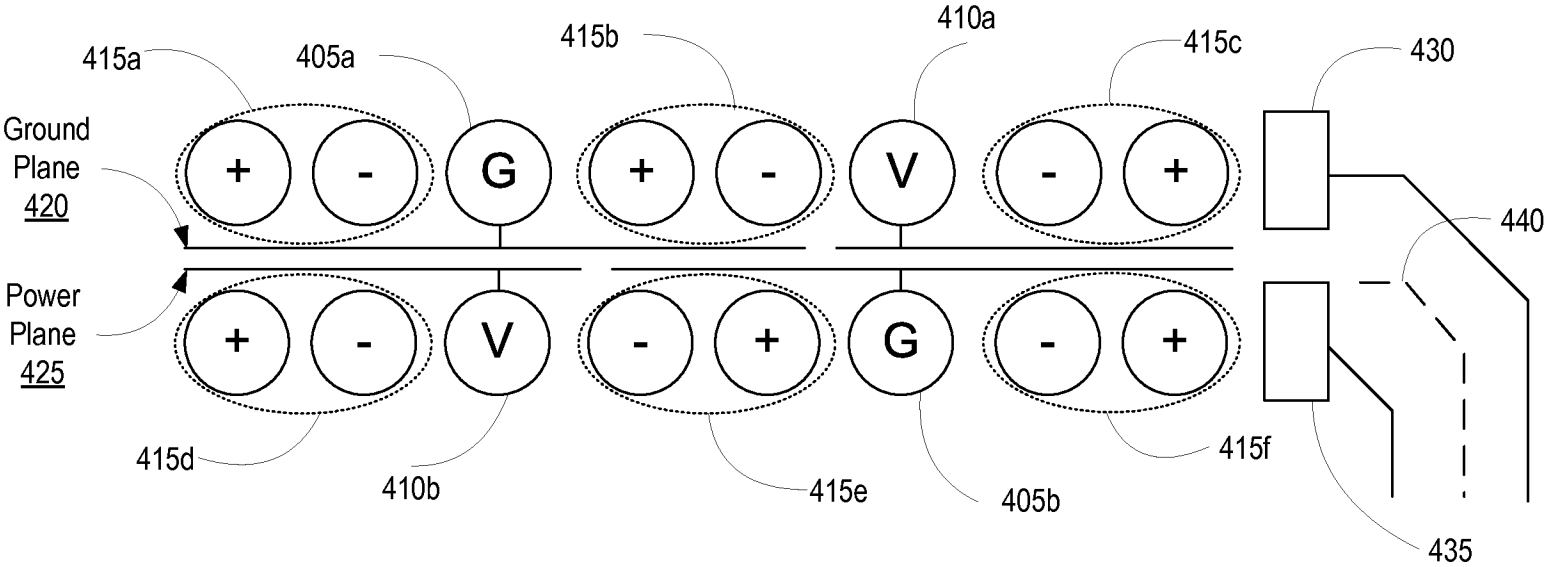
FIG. 4 is a diagram illustrating the organization of pins in the receptacle, according to one embodiment.

Like FIG. 3A, the pins in the receptacle 230 may also be organized in a similar fashion to enhance the signal integrity of signals received by the receptacle and transmitted by the receptacle 230. FIG. 4 is a diagram illustrating the organization of pins in the receptacle, according to one embodiment. In other embodiments the pins of receptacle 230 may be organized differently, and the receptacle 230 may include additional components not shown in FIG. 4. As described above enhancing signal integrity can be quite beneficial particularly for the transmission of high speed communications between the source device 110 and the sink device 115. The organization of the pins of the receptacle 230 as described in FIG. 4 is another example of enhancing the signal integrity of high speed communications transmitted between the source device 110 and the sink device 115 via the multimedia link 120.

In the example of FIG. 4, the receptacle 230 of the source device 110 or the skin device 115 includes one or more ground pins 405, one or more power pins 410, one or more differential pair pins 415, a ground plane 420, and a power plane 425. The pins in the receptacle 230 are each connected to their respective lines or wires included in the receptacle cable 235 connecting the receptacle 230 to additional circuitry of the device housing the receptacle 230, such as a PCB (printed circuit board) including a plurality of components for handling and processing signals received by the receptacle 230. For example, a ground pin 405 is connected to the ground wire included in the receptacle cable 235 connecting the receptacle 230 to additional circuitry.

In one embodiment, the ground plane 420 and the power plane 425 are placed substantially very close to one another in the receptacle 230. By placing the ground plane 420 and the power plane 425 very close to one another (within a threshold distance), results in the power plane 425 being AC (alternate current) coupled to the ground plane 420, thereby allowing the power pins 410, more specifically the power lines connected to the power pins 410, connected to the power plane 425 to behave as a signal return path in addition to the ground lines connected to the ground pins 405.

By having the power lines associated with the receptacle 230 behave as signal return paths in addition to the ground lines associated with the receptacle 230 the signal integrity of signals transmitted via the receptacle 230 is enhanced. Thus, by placing the ground plane 420 and the power plane 425 of the receptacle 230 very close to one another (within a threshold distance such that the power plane 425 is AC coupled to the ground plane 420) the signal integrity of signals transmitted via the receptacle 230 is enhanced.

In one embodiment, the ground pins 405, the power pins 410, and the differential pair pins 415 are organized in the receptacle 230, such that a ground pin 405 and a power pin 410 is placed between each pair of differential pair pins 415. As shown in the example of FIG. 4, ground pin 405*a* is placed between differential pair pins 415*a* and 415*b*, ground pin 405*b* is placed between differential pair pins 415*e* and 415*f*, power pin 410*a* is placed between differential pair pins 415*b* and 415*c*, and power pin 410*b* is placed between differential pair pins 415*d* and 415*e*.

In one embodiment, the pins of the receptacle 230 are distributed and connected to two different planes. For example, a first or top row of pins is connected to an upper plane 430, while a second or bottom row of pins is connected to a lower plane 435. In addition to enhancing or improving signal integrity, the reduction of crosstalk between the upper 430 and lower planes 435 is also beneficial as the prevention of crosstalk prevents the signals transmitted via one of the planes affecting or interfering with the signals in the other plane. In one embodiment, a shield plane 440 is located in between the upper plane 430 and the lower plane 435 of the receptacle 230. The shield plane 440 reduces the crosstalk between the signals of the upper plane 430 and the lower plane 435 of the receptacle 230, thereby improving the quality of signals received and transmitted by the receptacle 230.

Further, in addition to reducing the effects of crosstalk between the upper plane 430 and the lower plane 435, or the upper row of pins and the lower row of pins, of the receptacle 230, the shield plane 440 also assists in controlling the impedance of the various circuitry and components of the receptacle 230 and other portions/devices involved in the transmission and communication of signals. For example, the shield plane 440 affects or influences the characteristic impedance of one or more pins of the receptacle 230 as is further described in conjunction with FIG. 5 below.

Figure 5:
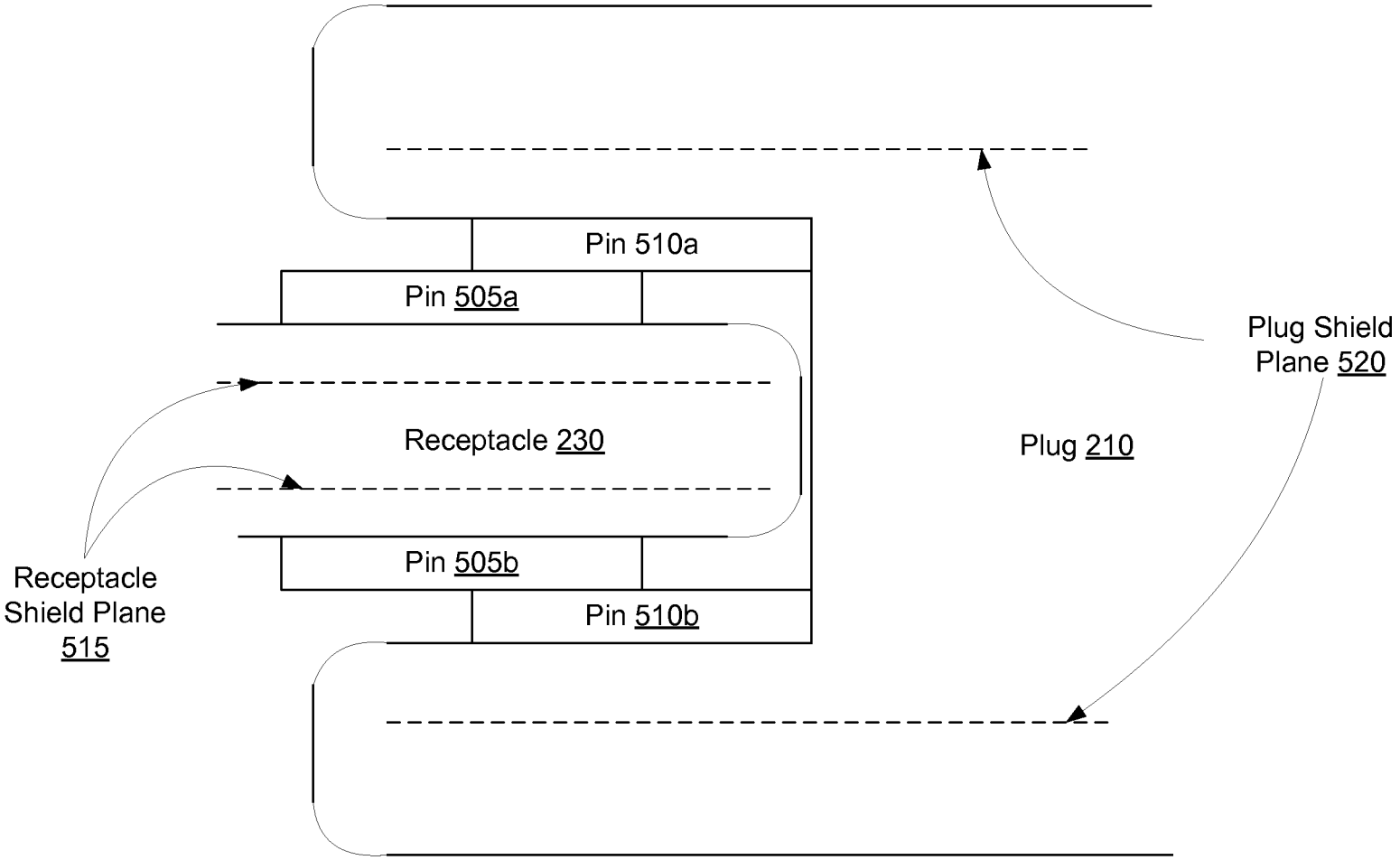
FIG. 5 is a diagram illustrating the plug of the multimedia link interfacing with the receptacle, according to one embodiment.

FIG. 5 is a diagram illustrating the plug of the multimedia link interfacing with the receptacle, according to one embodiment. In the example of FIG. 5, the receptacle 230 includes a pair of pins 505*a* and 505*b*, located in the upper plane and lower plane of the receptacle 230 respectively. The receptacle 230 also includes a receptacle shield plane 515 located in between the upper plane and the lower plane of the receptacle 230, and thus located in between the pins 505*a* and pin 505*b*. In other examples, the upper plane and lower plane of the receptacle 230 may include additional pins of different kinds and purposes. Further, the receptacle shield plane 515 could include one or more layers. In the example of FIG. 5 the receptacle shield plane includes two layers. As described in conjunction with FIG. 4 above, the shield plane reduces the crosstalk between signals transmitted via the upper plane including pin 505*a* and the lower plane including pin 505*b*.

Further, the receptacle shield plane 515 aids in controlling the impedance of the various components of the receptacle 230. In one embodiment, the receptacle shield plane 230 helps control the characteristic impedance associated with the pins 505*a* and 505*b*. For example, the distance between the receptacle shield plane 515 and the pin 505*a* or the pin 505*b* controls the characteristic impedance of each pin 505. Thus, in some examples, the distance of the receptacle shield plane 515 from either pin 505*a* or 505*b* may be determined based on the desired characteristic impedance of each pin. Controlling the characteristic impedance of the pins of the receptacle 230 further helps enhance the integrity of signal transmitted via the receptacle 230.

In the example of FIG. 5, the plug 210 includes pins 510*a*, 510*b* and a plug shield plane 520. Pin 510*a* is configured to connect with and interact with pin 505*a* of the receptacle 230 to transmit and receive signals to and from the receptacle 230. Similarly, pin 510*b* is configured to connect with and interact with pin 505*b* of the receptacle 230 to transmit and receive signals to and from the receptacle 230. In other examples, the plug 210 includes a plurality of pins of various types and purposes. In one embodiment, the plug 210 includes a plug shield plane 520 located behind each pin 510 of the plug 210. The plug shield plane 520 like the receptacle shield plane 515 aids in controlling the impedance of the various components of the plug 210.

In one embodiment, the plug shield plane 520 helps control the characteristic impedance associated with the pins 510*a* and 510*b*. For example, the distance between the plug shield plane 520 and the pin 510*a* or the pin 510*b* controls the characteristic impedance of each pin 510. Thus, in some examples, the distance of the plug shield plane 520 from either pin 510*a* or 510*b* may be determined based on the desired characteristic impedance of each pin 510. Controlling the characteristic impedance of the pins 510 of the plug 210 further helps enhance the integrity of signal transmitted via the plug 210 of the multimedia link 120.

In one embodiment, the receptacle cable 235 (not shown in FIG. 5) also includes a shield plane to reduce the crosstalk between the various lines of the receptacle cable 235 and to control the impedance of the receptacle cable 235. In one example, the shield plane included within the receptacle cable 235 is placed between a pair of lines of the receptacle cable 235 and the impedance of the receptacle cable 235 is determined based on the distance between the shield plane and the pair of lines. In other examples, one or more shield lines may be included in the receptacle cable 235 between one or more lines of the receptacle cable 235.

Upon reading this disclosure, those of skill in the art will appreciate still additional alternative designs for a multimedia link or receptacle of a device for the enhancement of the signal integrity of the multimedia link or receptacle of the device and for the control of impedance of the various components of the multimedia link or receptacle. Thus, while particular embodiments and applications of the present disclosure have been illustrated and described, it is to be understood that the embodiments are not limited to the precise construction and components disclosed herein and that various modifications, changes and variations which will be apparent to those skilled in the art may be made in the arrangement, operation and details of the method and apparatus of the present disclosure disclosed herein without departing from the spirit and scope of the disclosure as defined in the appended claims.

What is claimed is:

1. A multimedia link, comprising:

a plug, the plug comprising:

a ground pin;

a power pin;

a ground plane, the ground plane connected to a ground line of the multimedia link via the ground pin, the ground line configured as a signal return path;

a power plane, the power plane connected to a power line of the multimedia link via the power pin, the power line configured as a signal return path based on the distance between the ground plane and the power plane; and a cable configured to encompass the power line and the ground line of the multimedia link.

2. The multimedia link of claim 1, wherein the power line configured as a signal return path based on the distance between the ground plane and the power plane comprises:

the power line configured as a signal return path when the distance between the ground plane and the power plane of the plug is less than a threshold distance.

3. The multimedia link of claim 2, wherein the power plane is AC coupled to the ground plane when the distance between the ground plane and the power plane of the plug is less than the threshold distance.

4. The multimedia link of claim 1, wherein the plug further comprises:

two differential pair pins; and the ground pin positioned between the two differential pair pins.

5. The multimedia link of claim 1, wherein the plug further comprises:

two differential pair pins; and the power pin positioned between the two differential pair pins.

6. The multimedia link of claim 1, wherein the plug further comprises:

a plurality of pins; and a shield plane positioned behind the plurality of pins.

7. A multimedia receptacle comprising:

a ground pin;

a power pin;

a ground plane, the ground plane connected to a ground line via the ground pin, the ground line configured as a signal return path; and a power plane, the power plane connected to a power line via the power pin, the power line configured as a signal return path based on the distance between the ground plane and the power plane.

8. The multimedia receptacle of claim 7, wherein the power line configured as a signal return path based on the distance between the ground plane and the power plane comprises:

the power line configured as a signal return path when the distance between the ground plane and the power plane is less than a threshold distance.

9. The multimedia receptacle of claim 8, wherein the power plane is AC coupled to the ground plane when the distance between the ground plane and the power plane is less than the threshold distance.

10. The multimedia receptacle of claim 7, further comprising:

two differential pair pins; and wherein, the ground pin is positioned between the two differential pair pins.

11. The multimedia receptacle of claim 7, further comprising:

two differential pair pins; and wherein, the power pin is positioned between the two differential pair pins.

12. The multimedia receptacle of claim 7, further comprising:

an upper plane comprising a first plurality of pins;

a lower plane comprising a second plurality of pins; and a shield plane positioned between the upper plane and the lower plane.

13. The multimedia receptacle of claim 12, wherein the shield plane includes one or more shielding layers.

14. The multimedia receptacle of claim 12, further comprising:

a multimedia receptacle cable, configured to connect the first plurality of pins and the second plurality of pins to additional circuitry of the device via one or more lines; and a multimedia shield line included within the multimedia receptacle cable positioned between the one or more lines of the multimedia receptacle cable and configured to control the impedance of the multimedia receptacle cable.

* * * * *